United States Patent [19]

Nassimbene

[11] 4,440,515

[45] Apr. 3, 1984

[54] KEYBAR KEYBOARD

[75] Inventor: Ernie G. Nassimbene, Los Gatos, Calif.

[73] Assignee: International Business Machines Corporation, Armonk, N.Y.

[21] Appl. No.: 383,921

[22] Filed: Jun. 1, 1982

[51] Int. Cl.[3] ..... B41J 5/28

[52] U.S. Cl. ..... 400/479; 400/485; 400/490; 340/365 R; 200/5 R

[58] Field of Search ..... 400/472, 473, 474, 477, 400/478, 479, 479.1, 479.2, 485, 490, 492, 496; 178/17 C, 101-110; 200/5 R, 5 A; 235/145 R; 340/365 R, 365 C, 365 P, 365 L

[56] References Cited

U.S. PATENT DOCUMENTS

| | | | |
|---|---|---|---|
| 1,308,411 | 7/1919 | Going | 400/276.2 |
| 3,129,660 | 4/1964 | Miller | 400/472 |
| 3,166,638 | 1/1965 | Hills | 178/108 |
| 3,369,643 | 2/1968 | Avgerinos et al. | 340/365 P |
| 3,678,614 | 7/1972 | Nagel | 235/145 R |
| 3,794,905 | 8/1976 | Johnson | 400/496 |
| 3,938,642 | 2/1976 | Van Rumpt et al. | 178/17 C |
| 3,964,594 | 6/1976 | Gabbrielli et al. | 400/472 |
| 4,032,729 | 6/1977 | Koistinen | 200/5 A |
| 4,039,068 | 8/1977 | Giorza et al. | 400/491 |
| 4,042,439 | 8/1977 | Pounds | 156/292 |
| 4,085,302 | 4/1978 | Zenk et al. | 340/365 R |
| 4,186,638 | 2/1980 | Iijima | 200/5 A |
| 4,307,970 | 12/1981 | McGaughey, Jr. et al. | 400/473 |
| 4,363,942 | 12/1982 | Deeg et al. | 400/479 |
| 4,381,500 | 4/1983 | Urata et al. | 340/365 R |

OTHER PUBLICATIONS

IBM Technical Disclosure Bulletin, vol. 17, No. 5, Oct. 1974, p. 1479, "Low—Cost Key—Top Structure For Serpentine Strip Keyboard", E. E. Long.

IBM Technical Disclosure Bulletin, vol. 18, No. 4, Sep. 1975, pp. 1138-1139, "Magnetic Floating Elastic Diaphragm Switch", R. J. Sturm.

IBM Technical Disclosure Bulletin, vol. 16, No. 3, Aug. 1973, p. 954, "Molded Keyboard Structure", L. C. Bixler.

IBM Technical Disclosure Bulletin, vol. 10, No. 12, May 1968, p. 1844, "Unitary Plastic Keylever System", N. L. Anglin, et al.

*Primary Examiner*—Edgar S. Burr
*Assistant Examiner*—David A. Wiecking
*Attorney, Agent, or Firm*—John W. Girvin, Jr.

[57] ABSTRACT

A keyboard (61) includes plural keybar actuators (11) each including plural keys (19, 23, 27, 31) hingedly interconnected (25, 29, 33) and a sensing device (13). The keys of a keybar actuator are all actuated by a common finger (45) in touch typing and therefore are not jointly actuated. Depression of one key causes the keybar actuator (11) to pivot and the sensing device (13) indicates which key is depressed depending upon the amount of keybar actuator rotation. Alternate sensing devices include individual contact switches (79-81) associated with each key.

6 Claims, 6 Drawing Figures

KEYBAR KEYBOARD

BACKGROUND OF THE INVENTION

1. Field of the Invention

This invention relates to electrical keyboards and more specifically, to the key and key actuator mechanism of an electrical keyboard.

2. Description of the Prior Art

Prior art electrical keyboards typically include separate keys and key actuators individually associated with separate electrical switches. Depression of a single key causes its associated actuator to effect switch closure resulting in an electrical indication of which key of the plurality of keys was depressed. Such prior keyboards include numerous separate parts and have attendant assembly problems and high costs associated therewith.

Electrical keyboards such as that disclosed in U.S. Pat. No. 3,974,905 have been proposed which utilize a single actuator part in the form of multiple molded key levers, there being a key lever for each key. Each such key lever actuates a separate electrical switch upon key depression. The patent states that the keys may be molded as an integral part of the mechanism thus requiring a rather complex mold to mold the individual keys and key levers. This device does have the advantage that each key can provide a conventional tactile response to operator key depression.

A further prior art approach is exemplified in U.S. Pat. No. 4,032,729 wherein each key of a keyboard is integrally formed with the topmost support surface and is independently hinged therefrom. Each such key has a return spring and corresponding electrical switch associated therewith. Again, a rather large and complex mold must be utilized to form the structure.

SUMMARY

In order to provide a low cost keyboard which provides a good tactile response, and which is made of relatively simple molded plastic parts, I have connected together plural keys which are normally actuated by a common finger and mounted them to a common lever which pivots about a common pivot. Since the degree of lever rotation about the common pivot is a function of which key is depressed by the operator, a single sensing device may be used for each key lever to sense which of the plural keys located thereon has been depressed. Although all other keys connected to the common lever move when any one key is depressed, it has been found that operator keying is not affected by this key movement since the other keys are actuated by the same finger as the depressed key which can only depress one such connected key at a time. Various switching schemes may be employed with my invention including the use of separate switches for each key.

The foregoing and other features and advantages of this invention will be apparent from the following more particular description of the preferred embodiments of the invention as illustrated in the accompanying drawing.

IN THE DRAWING

DETAILED DESCRIPTION

Figure 1:
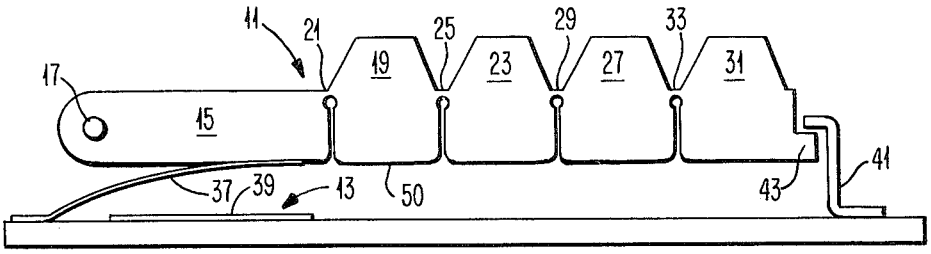
FIG. 1 is a side view of a keybar actuator and sensing device in its unactuated state.

Referring now to the drawing and more particularly to FIG. 1 thereof, there is shown a side view of a keybar actuator 11 and its associated sensing device 13 in its unactuated state. The keybar actuator 11 includes a key lever 15 portion which is pivoted about pivot bar 17. Individual key 19 is connected to the key lever 15 by an integrally formed hinge 21. Key 23 is connected to key 19 by hinge 25, key 27 is connected to key 23 by hinge 29 and key 31 is connected to key 27 by hinge 33. Each of the hinges 21, 25, 29 and 33 are integrally formed with the keys 19, 23, 27 and 31 and the key lever 15. The keybar actuator 11 may be made of a plastic material such as polyester.

The sensing device 13 is located on a circuit board 35 beneath the keybar actuator 11 and includes a metal leaf spring 37 and a signal pick-up strip 39. A retainer member 41 also mounted on the circuit board 35 forms an upstop with the end 43 of the keybar actuator 11.

Figure 2:
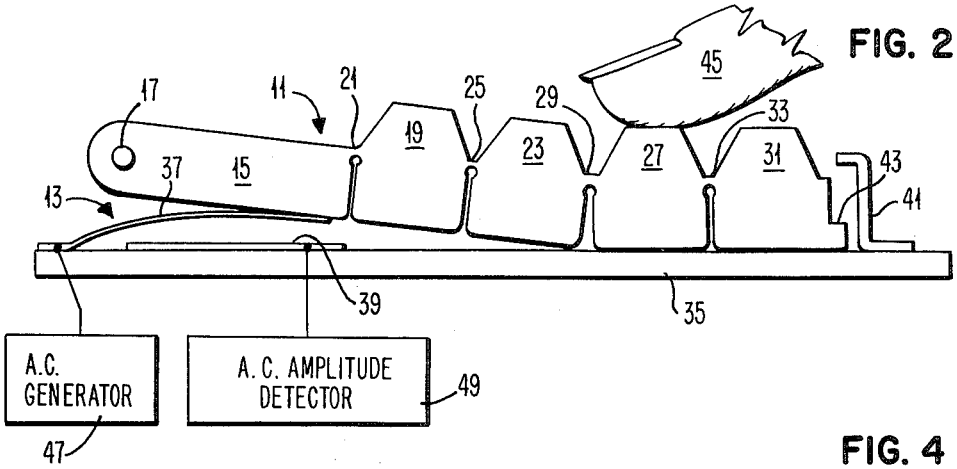
FIG. 2 is a side view of a keybar actuator and sensing device in its actuated state.

Referring now to FIG. 2 of the drawing, a side view of the keybar actuator 11 and its sensing device 13 are depicted in their actuated state. Finger 45 has depressed key 27 causing the key lever 15 to pivot downward about the pivot bar 17 deflecting the metal leaf spring 37 in a downward direction. Hinges 21, 25, and 29 are flexed to allow the keybutton 27 to contact the circuit board 35. The metal leaf spring 37 is deflected by differing amounts depending upon which key 19, 23, 27 or 31 is depressed, key 31 effecting the least amount of downward deflection of the metal leaf spring 37 and key 19 effecting the most deflection.

An A.C. generator 47 supplies an electrical signal to the leaf spring 37 which is sensed at the ground plane signal pick-up strip 39. An A.C. amplitude detector 49 detects the strength of the coupled signal based on the proximity of the metal leaf spring 37 to the signal pick-up strip 39. The strength of the picked up signal thus indicates which of the keys, 19, 23, 27 or 31 had been depressed.

The underside 50 of the keybar actuator 11 may be metallized to make ohmic contact with the circuit board 35 upon full key 19, 23, 27 or 31 depression. Such contact may be sensed to provide a gating signal to the A.C. amplitude detector 49 in order to prevent improper detection upon partial deflection of the keybar actuator 11.

Figure 3:
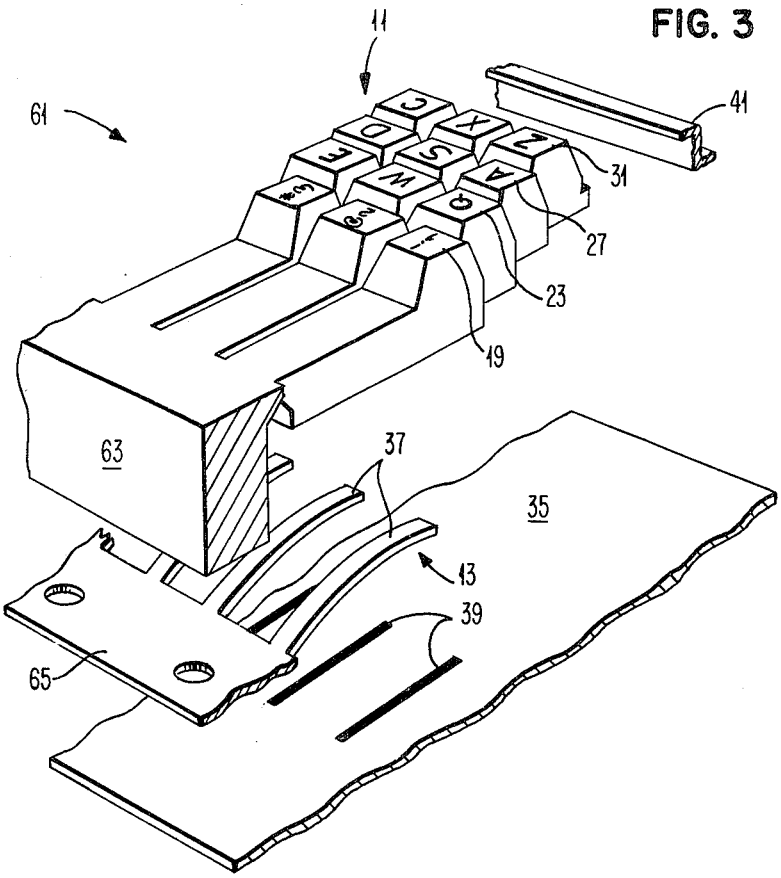
FIG. 3 is a schematic assembly view of a keyboard incorporating plural keybar actuators and their associated sensing devices.

Referring now to FIG. 3 of the drawing, a schematic assembly view of a keyboard 61 incorporating plural keybar actuators 11 and their associated sensing devices 13 is depicted. The keybar actuators 11 are molded in a unitary member 63. The keybars 11 are canted with respect to the orientation of the keyboard 61 corresponding to a conventional typewriter keyboard. Thus, each of the keys 19, 23, 27, 31 on a keybar 11 are normally actuated by a common finger in conventional touch typing.

The sensing device 13 includes a leaf spring comb 65 having plural metal leaf springs 37 which are located under the keybars 11 and over the signal pick-up strips 39 on the circuit card 35 as previously described.

Figure 4:
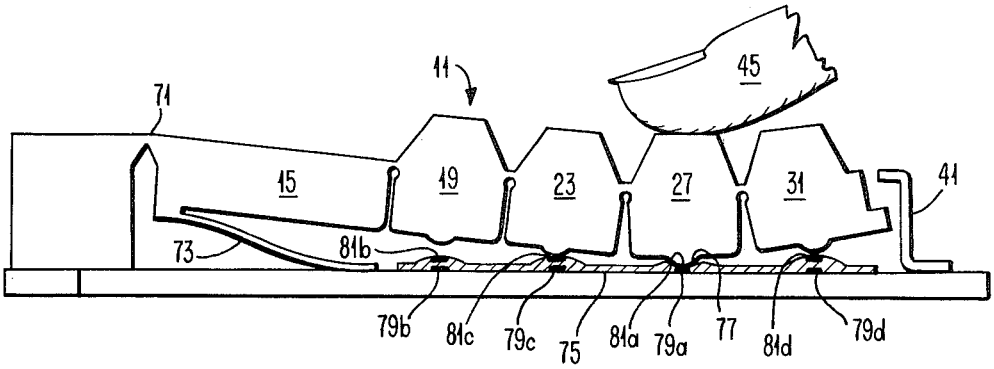
FIG. 4 is a side view of a keybar actuator with an integrally formed pivot and restoring spring and its associated sensing device.

Referring now to FIG. 4 of the drawing, a side view of a keybar actuator 11 and integrally formed pivot 71 and restoring spring 73 and its associated sensing device 75 is depicted in its actuated state. Depression of the key 27 by the finger 45 causes the actuating surface 77 thereof to physically contact and press down on the sensing device 75. The sensing device 75 is a membrane switch arrangement per se well known in the art having a pair of switching contacts 79*a–d* and 81*a–d* located under each of the keys 19, 23, 27 and 31. Operator depression of one of the keys 19, 23, 27, 31 forces its actuating surface 77 downward against the uppermost contact 81*a* causing it to close contact with the lower contact 79*a* indicating key actuation to the utilization device. The integral restoring spring 73 causes the keybar actuator 11 to assume its unactuated position allowing the membrane switch sensing device 75 to restore its contacts 79*a–d* and 81*a–d* to their normally open position.

Figure 5:
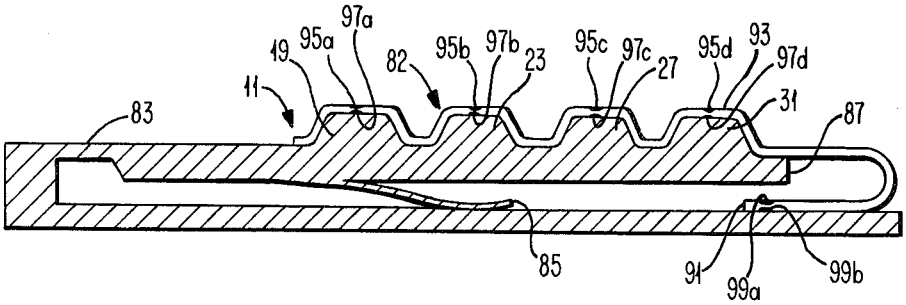
FIG. 5 is a side view of a keybar actuator with an integrally formed sensing device.

Referring now to FIG. 5 of the drawing, a side view of a keybar actuator 11 with an integrally formed sensing device 82 is depicted. The keybar actuator 11 has an integrally molded hinge 83 and return spring 85 formed therein. Additionally, each of the keys 19, 23, 27 and 31 are formed as a part of the keybar actuator 11 and are non-hingedly connected one to another. Depression of any of the keys 19, 23, 27, 31 causes the keybar actuator 11 to pivot about the molded hinge 83 against the bias of the return spring 85 until the end 87 contacts the lower portion 91 of the sensing device 82.

The sensing device 82 is a contoured membrane switch sheet 93 formed over the keybar actuator 11. Upper contacts 95*a–*95*d* mate with corresponding lower contacts 97*a–*97*d*.

Operator depression of a given key such as key 23 causes the upper contact 95*b* associated therewith to physically contact the lower contact 97*b* of the contoured membrane switch sheet 93. Further operator pressure causes the keybar actuator 11 to pivot in a downward direction until the end 87 comes to rest against the lower portion 91 causing the contacts 99*a* and 99*b* on the membrane switch sheet 93 to close. The closing of the contacts 99*a* and 99*b* closes an electrical path allowing the closed contacts 95*b* and 97*b* to be indicated to the utilization device thus identifying the depressed key 23.

Figure 6:
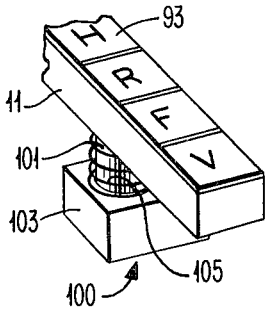
FIG. 6 is a perspective view of a keybar actuator with an integrally formed sensing device and a tactile response device.

Referring now to FIG. 6 of the drawing, a perspective view of a keybar actuator 11 with an integrally formed sensing device and tactile response device 100 is depicted. The keybar actuator 11 has a contoured membrane switch sheet 93 located thereover which operates as described with respect to FIG. 5. As the keybar actuator 11 pivots downward, it pushes downward on the plunger 101 of a snap switch 103. The snap switch 103 performs the same function as the switch made up of the contacts 99*a* and 99*b* of FIG. 5 and, in addition, provides a tactile feedback similar to that experienced with conventional keyboards. A spring 105 provides keybar actuator 11 return upon operator release thereof.

Various sensing devices may be utilized in order to determine which key of a keybar actuator 11 has been depressed. For example, when utilizing the hingedly interconnected keys 19–31 of FIGS. 1–4, a fixed photocell could be employed to sense code marks located on the keybar actuator or multiple photocells located below the keybar actuator 11 could sense the level of depression of the keybar actuator 11 or the capacitance could be measured between the lever 15, and the ground plane strip 39. Additionally, the angle at which the keybar actuator 11 is rotated to could be determined by utilizing a potentiometer at the pivot bar 17.

Further, the keybar actuator 11 depicted in FIGS. 1–4 can be attached to the frame at its end 43, the end 43 being extended as the keylever 15 portion and connected to the key 31 by a hinge such as hinge 21. The keybar actuator 11 would thus be in the form of a bridge member taking on various U-shapes as the individual keys 19–31 are depressed.

While the invention has been particularly shown and described with reference to the preferred embodiments thereof, it will be understood by those skilled in the art that the foregoing and other changes in form and detail may be made therein without departing from the spirit and scope of the invention.

What is claimed is:

1. A keyboard comprising:

a plurality of keybar actuators, said keybar actuators each comprising:

at least three keys interconnected one to the other and jointly movable in the same common direction about at least one common pivot upon depression of any key of a given keybar actuator, said remaining keybar actuators being independently pivoted to remain stationary during such movement of said given keybar actuator;

switch actuation means responsive to the movement in said common direction of any depressed key of said given keybar actuator to indicate which one of said at least three keys of said given keybar actuator was depressed upon movement of said given keybar actuator in said common direction.

2. The keyboard of claim 1 wherein each of said keys in each of said keybar actuators are hingedly connected to at least one other key in said keybar actuator.

3. The keyboard of claim 1 wherein said switch actuation means includes individual switches corresponding to each individual key of a keybar actuator, operator depression of a key actuating the associated individual switch.

4. The keyboard of claim 3 wherein each of said keys in each of said keybar actuators are hingedly connected to at least one other key in said keybar actuator and wherein said individual switches are located under each individual key.

5. The keyboard of claim 3 wherein said individual switches are located on top of each key and wherein said switch actuation means further includes a common switch actuated upon depression of any of said keys of a keybar actuator.

6. The keyboard of claim 1 wherein each of said keybar actuators has a single integral return spring for opposing key depression and for returning a depressed keybar actuator to an initial position.

* * * * *